US010577916B2

(12) United States Patent
Clark et al.

(10) Patent No.: US 10,577,916 B2
(45) Date of Patent: Mar. 3, 2020

(54) METHOD AND APPARATUS FOR CONTINUOUS WELLBORE CURVATURE ORIENTATION AND AMPLITUDE MEASUREMENT USING DRILL STRING BENDING

(71) Applicant: Nabors Drilling Technologies USA, Inc., Houston, TX (US)

(72) Inventors: Tyler Clark, Montgomery, TX (US); Matthew White, Spring, TX (US); Peter Harvey, Tampa, FL (US); Harmeet Kaur, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 14 days.

(21) Appl. No.: 15/232,467

(22) Filed: Aug. 9, 2016

(65) Prior Publication Data

US 2017/0044890 A1 Feb. 16, 2017

Related U.S. Application Data

(60) Provisional application No. 62/205,383, filed on Aug. 14, 2015.

(51) Int. Cl.
*E21B 47/00* (2012.01)
*E21B 47/022* (2012.01)

(52) U.S. Cl.
CPC ..... *E21B 47/0006* (2013.01); *E21B 47/022* (2013.01)

(58) Field of Classification Search
CPC ..... E21B 47/0006; E21B 47/022
See application file for complete search history.

(56) References Cited

U.S. PATENT DOCUMENTS 2,930,137 A * 3/1960 Arps ..... E21B 47/02 33/312
5,193,628 A * 3/1993 Hill, III ..... E21B 47/0006 175/45
2015/0098627 A1* 4/2015 Ye ..... G01V 1/50 382/109
2017/0306748 A1* 10/2017 Marland ..... E21B 44/00

* cited by examiner

*Primary Examiner* — Robert E Fuller
*Assistant Examiner* — Lamia Quaim
(74) *Attorney, Agent, or Firm* — Adolph Locklar

(57) ABSTRACT

A method includes coupling a strain gauge to a tubular member, and positioning the tubular member in the wellbore such that the tubular member is placed under bending stress by a curvature or deviation in the wellbore. The method also includes measuring bend on the tubular member with the strain gauge in at least one plane and determining one or more of the magnitude or orientation of the curvature of the wellbore based on an output of the strain gauge.

16 Claims, 11 Drawing Sheets

METHOD AND APPARATUS FOR CONTINUOUS WELLBORE CURVATURE ORIENTATION AND AMPLITUDE MEASUREMENT USING DRILL STRING BENDING

CROSS-REFERENCE TO RELATED APPLICATIONS

This application is a nonprovisional application which claims priority from U.S. provisional application No. 62/205,383, filed Aug. 14, 2015.

TECHNICAL FIELD/FIELD OF THE DISCLOSURE

The present disclosure relates generally to measurement of a wellbore, and specifically to measurement of wellbore curvature during a drilling operation.

BACKGROUND OF THE DISCLOSURE

When drilling a wellbore, accurately tracking the wellbore path may be important to ensure an underground formation is encountered. Tracking and feedback of control inputs may be of particular importance during directional drilling operations. Typically, a measurement while drilling (MWD) system takes a survey of the wellbore orientation while the drill string is not moving to improve accuracy. The survey may include measurements by one or more sensors including, for example, accelerometers, magnetometers, and gyros. Due to the operating costs of drilling a well, it may be undesirable to halt the drill string more frequently than necessary to obtain wellbore orientation measurements. Survey stations are therefore typically taken at 30-90 foot increments, corresponding to the length of the pipe stands used on the drill string. Information about the path between adjacent stations may not be available. Typically, the well path between survey stations is interpolated based on a curve fitting such as best or least curvature. However, any deviation between survey stations may go undetected. Deviations may cause inaccuracy in apparent build direction as the wellbore continues to be drilled or may allow friction points in the wellbore to go unidentified.

SUMMARY

The present disclosure provides for a method for determining curvature of a wellbore. The method includes coupling a strain gauge to a tubular member, and positioning the tubular member in the wellbore such that the tubular member is placed under bending stress by a curvature or deviation in the wellbore. The method also includes measuring bend on the tubular member with the strain gauge in at least one plane and determining one or more of the magnitude or orientation of the curvature of the wellbore based on an output of the strain gauge.

The present disclosure also provides for a method for determining curvature of a wellbore. The method includes coupling a plurality of strain gauges about a tubular member and positioning the tubular member in the wellbore such that the tubular member is placed under bending stress by a curvature or deviation in the wellbore. The method also includes measuring bend on the tubular member with the strain gauges in at least one plane and determining one or more of the magnitude or orientation of the curvature of the wellbore based on output of the strain gauges.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
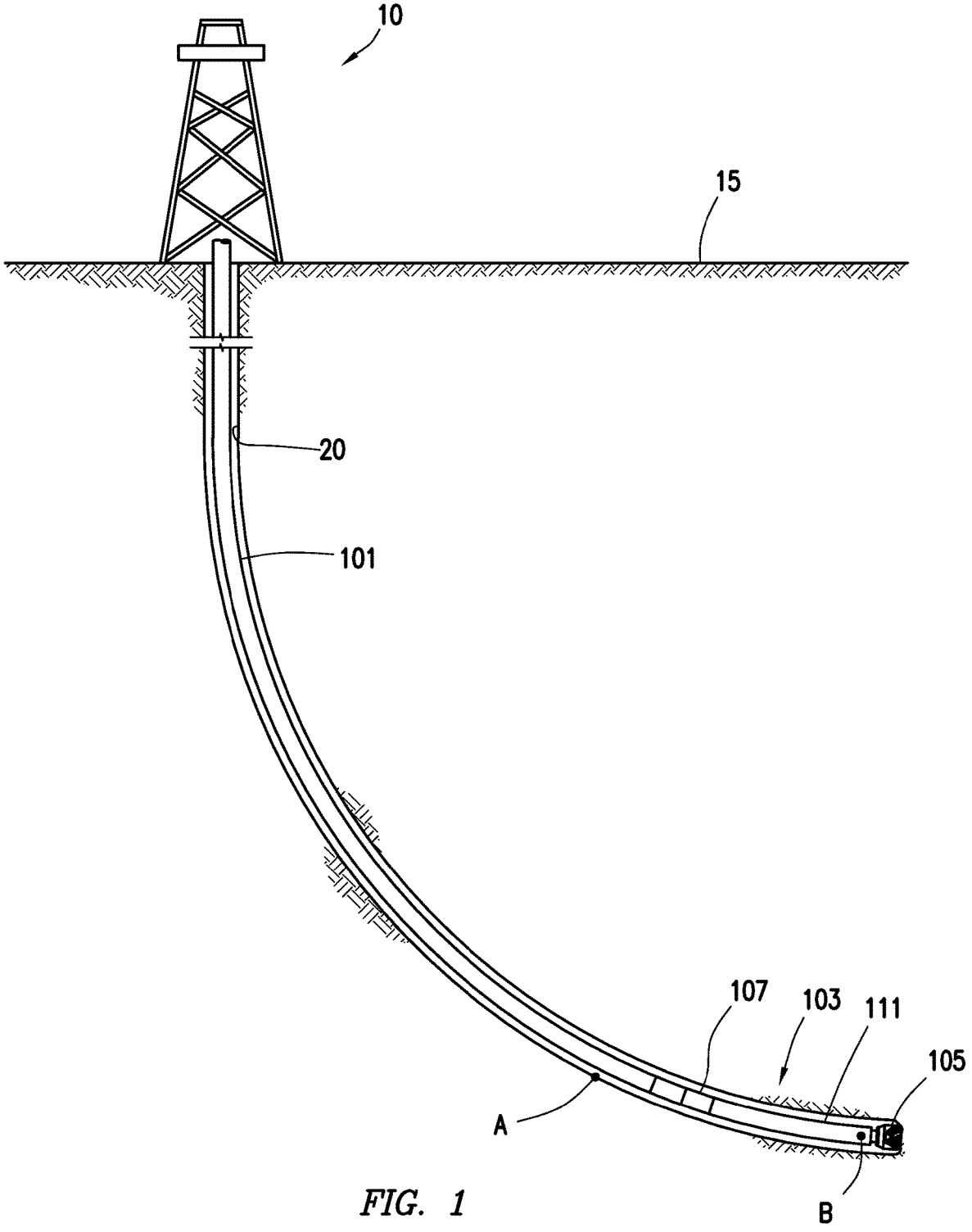
FIG. 1 depicts an overview of a drilling operation consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts drilling rig 10 at surface 15 drilling wellbore 20. Drill string 101 may be made up of sections of pipe and may include bottom hole assembly (BHA) 103 and drill bit 105. As understood in the art, the sections of pipe may be threadedly connected and may be added in 30 to 90 foot lengths known as pipe stands at the top end of drill string 101 at drilling rig 10 as wellbore 20 is drilled. Drill string 101 may include MWD system 107. In some embodiments, as depicted in FIG. 1, MWD system 107 may be located as a part of BHA 103. In other embodiments as understood in the art, MWD system 107 may be positioned at a different location along drill string 101.

MWD system 107 may include one or more sensors including, for example and without limitation, one or more accelerometers, magnetometers, gyros, gamma sensors. MWD system 107 may take a survey of wellbore 20 at locations along wellbore 20 referred to herein as survey stations. The survey may include, for example and without limitation, determination of azimuth, inclination, and toolface of drill string 101. MWD system 107 may take surveys when drill string 101 is stationary. For example, in some embodiments, surveys may be taken when drill string 101 is stopped to add an additional pipe stand to the top of drill string 101. Survey stations may thus be 30-90 feet apart. One having ordinary skill in the art with the benefit of this disclosure will understand that survey stations may be taken at any point along wellbore 20. Two example survey stations (A and B) are depicted in FIG. 1.

Figure 2:
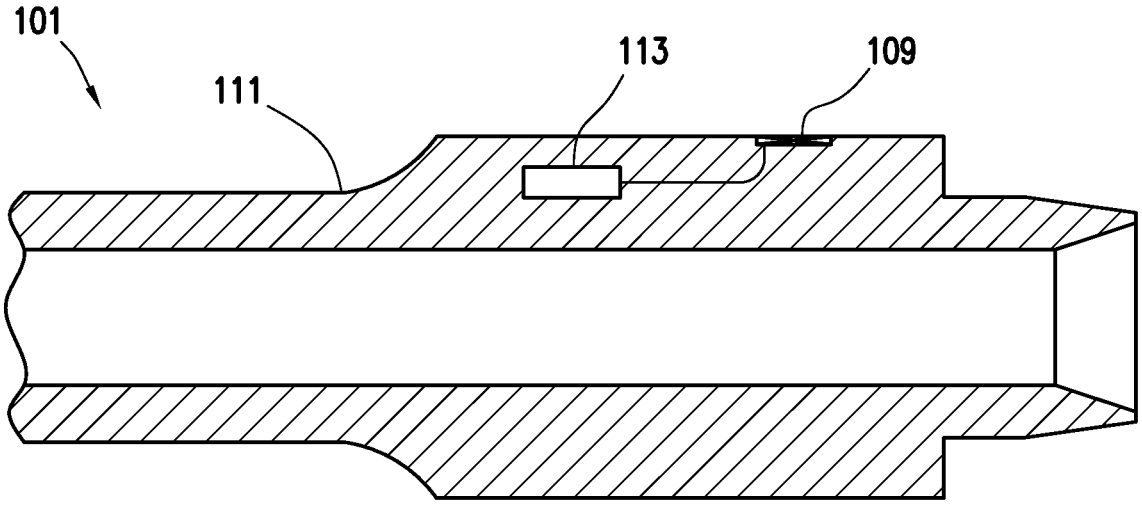
FIG. 2 depicts a cross section of a drill collar consistent with at least one embodiment of the present disclosure.

As depicted in FIG. 2, one or more strain gauges 109 may be coupled to a tubular member such as drill collar 111 of drill string 101. Strain gauge 109 is a transducer that allows the measurement of mechanical strain in an object. In embodiments of the present disclosure, strain gauge 109 may be coupled to a portion of drill string 101 to detect bending strain on that portion of drill string 101. In some embodiments, each strain gauge 109 may measure mechanical strain in one plane of bending of drill collar 111. Although discussed with regard to drill collar 111, strain gauge 109 may be coupled to any part of drill string 101. Strain gauges 109 may be positioned at other positions along drill string 101 without deviating from the scope of this disclosure depending on where bending is to be detected. Additionally, although bending of drill collar 111 is described as being detected by one or more strain gauges 109, bending may be detected by any suitable transducer including, for example and without limitation, piezoelectric elements, magnetic ranging, laser ranging, sonic ranging, or multi-axis gyros positioned within drill string 101.

Figure 3:
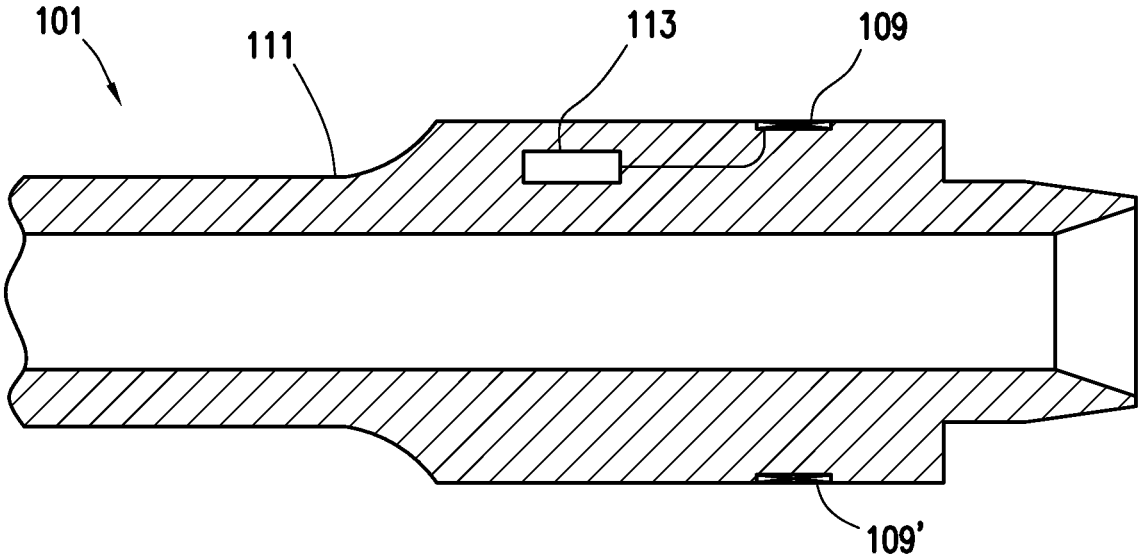
FIG. 3 depicts a cross section of a drill collar consistent with at least one embodiment of the present disclosure.

In some embodiments, strain gauge 109 may vary in resistance depending on the amount of strain in drill collar 111, known in the art as "bend on bit." In some embodiments, strain gauge 109 may be electrically coupled to sensor electronics 113, which may receive signals from strain gauge 109. In some embodiments, sensor electronics 113 may log the strain information received from strain gauge 109 to memory for subsequent processing or transmission. In some embodiments in which strain gauge 109 is a resistive-type strain gauge, strain gauge 109 may be used as part of a Wheatstone bridge. A Wheatstone bridge is a network of resistive elements adapted to turn relatively small changes in resistance across one or more of the resistive elements into a larger and more easily detected change in voltage. In some embodiments, a single strain gauge 109 may be wired as a quarter bridge Wheatstone bridge. In some embodiments, multiple strain gauges 109 may be used to create a half or full bridge circuit. For example, in FIG. 3, an opposing strain gauge 109' is positioned on drill collar 111 opposite strain gauge 109. In such a configuration, when strain gauge 109 detects tension, opposing strain gauge 109' will detect compression and vice versa. Such opposing response may lead to higher gain on output voltage for the Wheatstone bridge.

Figure 4B:
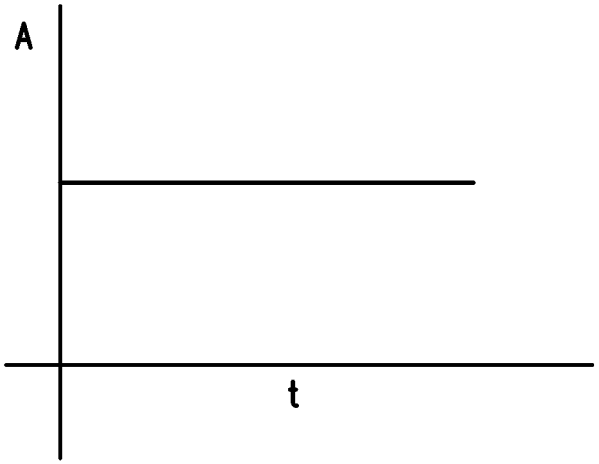
FIG. 4B depicts the output of the strain gauge of the drill collar in the wellbore of FIG. 4A while rotating.
Figure 4A:
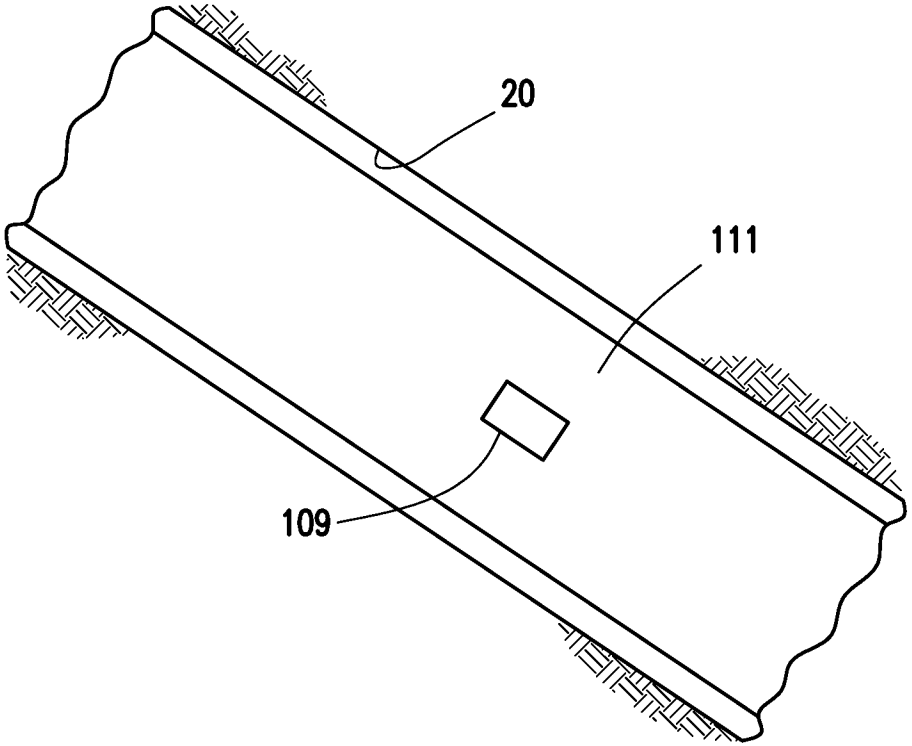
FIG. 4A depicts the drill collar of FIG. 2 positioned in a wellbore.

In operation, a survey shot may be taken at survey station A as depicted in FIG. 1. A survey shot is a measurement by the MWD system. As drill string 101 is rotated during a rotary drilling operation, for example between survey stations A and B, strain gauge 109 may be monitored to detect bend in drill collar 111. When wellbore 20 is generally straight as depicted in FIG. 4A, drill collar 111 is not under bending stress. Thus, the amplitude of the output from strain gauge 109 in time, depicted in FIG. 4B, is generally constant as drill collar 111 is rotated due to the lack of bending moment imposed on drill collar 111 as it rotates.

Figure 5B:
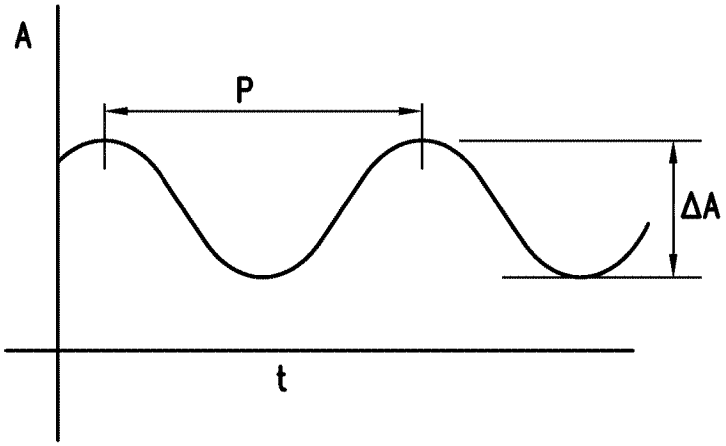
FIGS. 5B, 5C depict the output of the strain gauge of the drill collar in the wellbore of FIG. 5A while rotating.
Figure 5C:
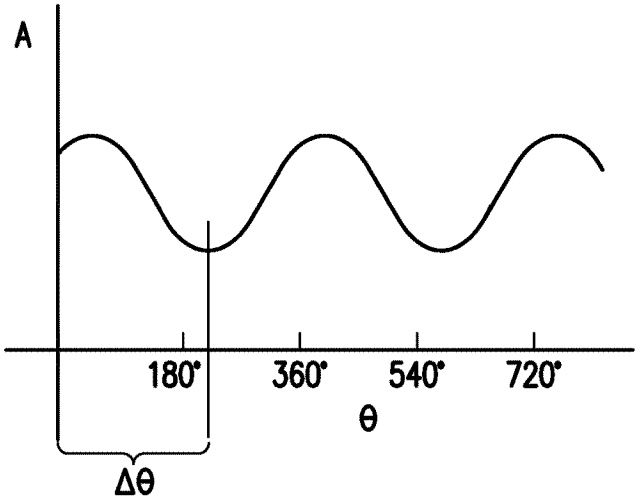
Figure 5A:
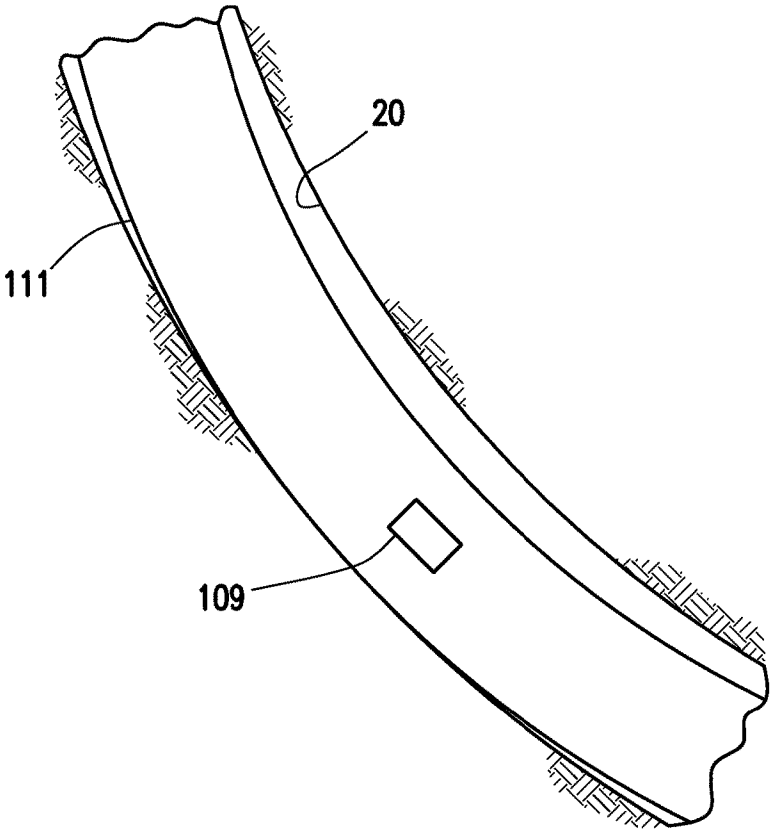
FIG. 5A depicts the drill collar of FIG. 2 positioned in a curved wellbore.

When wellbore 20 includes a curvature as depicted in FIG. 5A, drill collar 111 receives a bending moment from wellbore 20. The side of drill collar 111 on the inside of the curvature is placed under compressive stress, while the side of drill collar 111 on the outside of the curvature is placed under tensile stress. Thus, the amplitude of the output from strain gauge 109 in time, depicted in FIG. 5B, is generally sinusoidal as drill collar 111 is rotated. Although depicted as a sine wave, the output from strain gauge 109 may include additional information such as noise. In some embodiments, signal processing electronics including one or more filters may be utilized to remove such noise. As understood in the art, the general form of a sine wave is given by:

$$y(t)=A\sin(\omega t+\phi)+B$$

wherein A is the amplitude, ω is the frequency, φ is the angle offset from a reference plane, and B is a vertical offset. As depicted in FIG. 5B, the period P (given by the inverse of ω) of the sinusoidal waveform generally corresponds to the speed of rotation of drill collar 111. In some embodiments, by using logged RPM data from a top drive or kelly, the received data may be further refined as understood in the art. The vertical offset B may be caused by, for example and without limitation, DC offset of the sensor or loading on drill collar 111 by, for example, weight on bit. For the sake of this disclosure, a decrease in the amplitude of the output of strain gauge 109 will be described as an increase in compressive loading or decrease in tensile loading, although one having ordinary skill in the art with the benefit of this disclosure will understand that the specific configuration of strain gauge 109 and sensor electronics 113 may mean the reverse is true. One having ordinary skill in the art with the benefit of this disclosure will understand that the amplitude depicted in FIGS. 4B, 5B may be the output of strain gauge 109 (e.g. resistance), voltage output of the associated sensor electronics 113, or calculated strain.

In some embodiments of the present disclosure, the difference between the maximum amplitude and the minimum amplitude of the output of strain gauge 109, referred to herein as amplitude differential AA, may represent the severity or magnitude of the curvature of wellbore 20 where drill collar 111 is located. In some embodiments, sensor electronics 113 may be calibrated such that the sensor data may be converted into a measurement of curvature of wellbore 20. In some embodiments, sensor electronics 113 may include signal processing circuitry and software to filter noise from strain gauge 109. In some embodiments, AA may be logged with regard to position of drill collar 111 within borehole 20, allowing the magnitude of deflection of wellbore 20 during the drilling operation to be determined with respect to depth. As understood by one having ordinary skill in the art with the benefit of this disclosure, the depth of the wellbore may be the total drill string path length known as calculated depth or measured depth. In some embodiments, by logging the length of the drill string in time and combining the depth data with the data from strain gauge 109, the orientation and magnitude of wellbore curvature may be determined with regard to the depth of the wellbore.

In some embodiments, the survey shot taken at survey station A may include toolface such that the rotational or angular orientation of drill collar 111 and thus the angular orientation of strain gauge 109 relative to a fixed reference frame within wellbore 20 is known. In some embodiments, the fixed reference frame may be, for example and without limitation, the Earth's gravity field, geomagnetic north, a magnetic anomaly in the surrounding formation, a gamma plane, etc. Additionally, in some embodiments, the angular orientation of drill collar 111 may be measured at all times during the drilling operation. The angular position of the sensitive axis of strain gauge 109 may be logged simultaneously with the readings of strain gauge 109. In such an embodiment, by logging the output sinusoidal wave of strain gauge 109 with respect to rotation angle relative to a fixed reference frame, referred to herein as angular offset $\Delta\theta$ (given above by $\varphi$), the direction of the curvature of wellbore 20 may be determined. As depicted in FIG. 5C, In some embodiments, by combining $\Delta A$ with $\Delta\theta$, the direction and degree of curvature of wellbore 20 may be determined continuously along wellbore 20 between survey station A and survey station B. The direction and degree of curvature of wellbore 20 may be used to determine a continuous azimuth and inclination of wellbore 20, from which an accurate model of the progression of wellbore 20 may be determined. In some embodiments, the azimuth or inclination may be used by a driller to confirm the build rate and direction in a directional drilling apparatus which may, for example and without limitation, improve drilling accuracy and reduce divergence and overcorrection in the path of wellbore 20. Additionally, a measure of tortuosity may be determined for wellbore 20.

Figure 6:
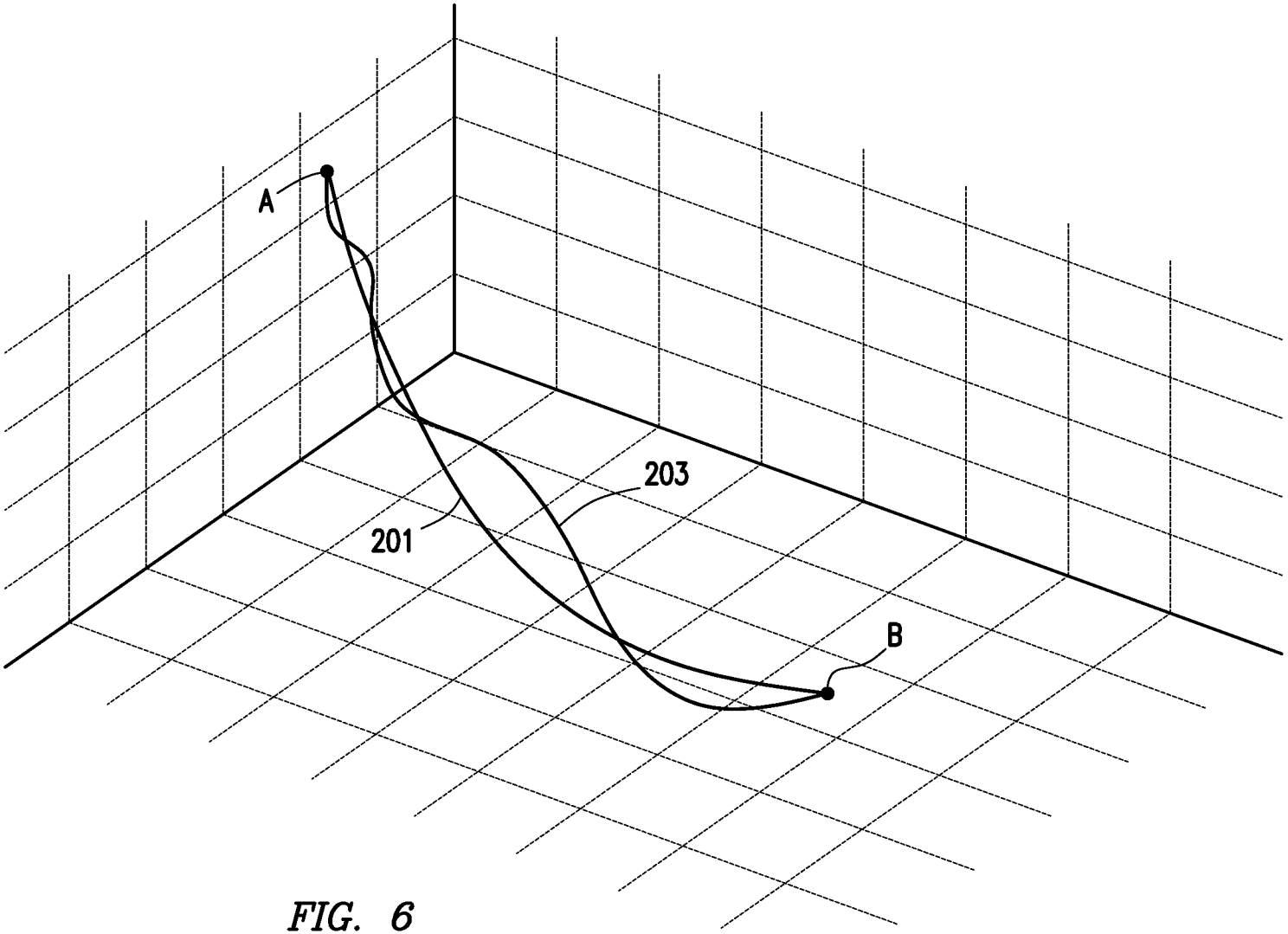
FIG. 6 depicts a representation of a curve fit and calculated well path.

As depicted in FIG. 6, the difference between a least curvature model 201 and the calculated well path 203 demonstrates the increase in accuracy of the model of wellbore 20. In some embodiments, a survey taken at survey station B may be taken. In some embodiments, the survey may be used to, for example and without limitation, update or revise the model generated from the output of strain gauge 109 or to calibrate sensors of MWD system 107 or sensor electronics 113.

In some embodiments, as previously described, strain gauge 109 may be utilized during rotation of drill string 101 during, for example and without limitation, rotary drilling operations. As understood in the art, rotary drilling operations may include drilling with rotary steerable systems. In some embodiments, strain gauge 109 may be included as part of the rotary steerable system.

Figure 7B:
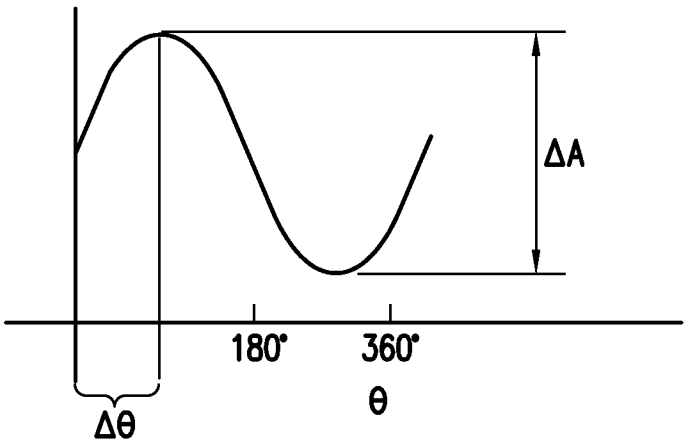
FIGS. 7A, 7B depict a rotation of the drill collar of FIG. 2.
Figure 7A:
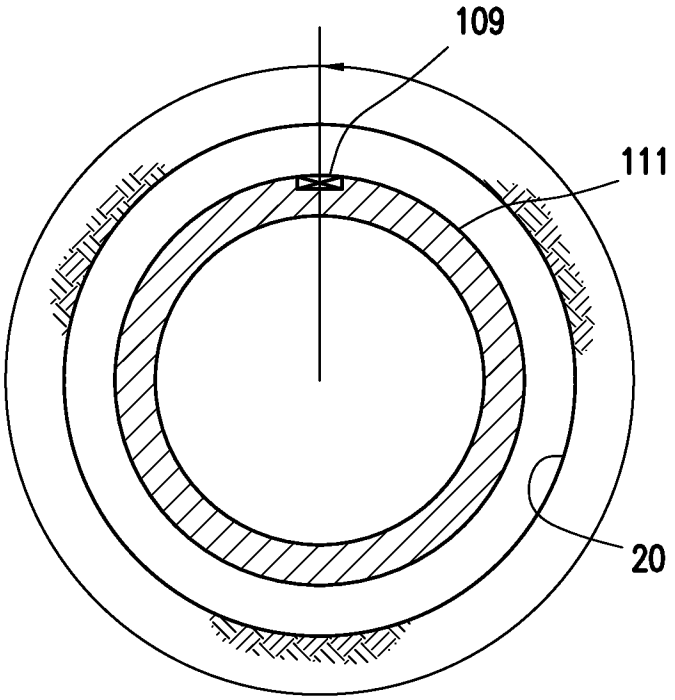
Figure 8B:
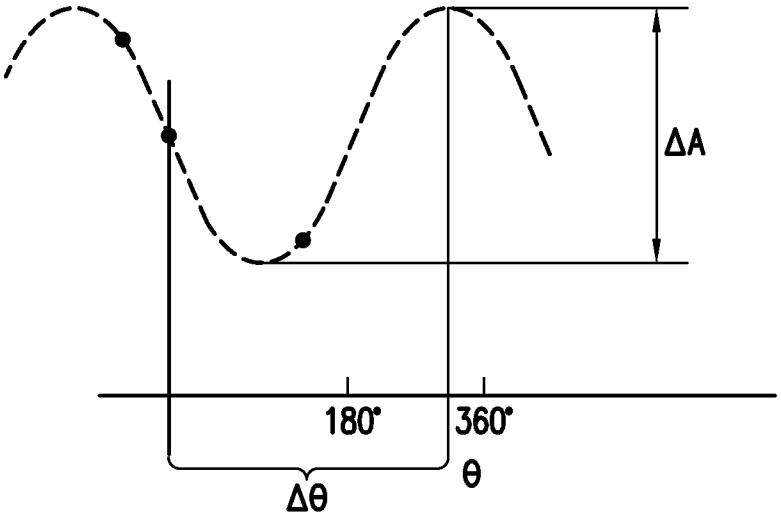
FIGS. 8A, 8B depict a partial rotation of the drill collar of FIG. 2.
Figure 8A:
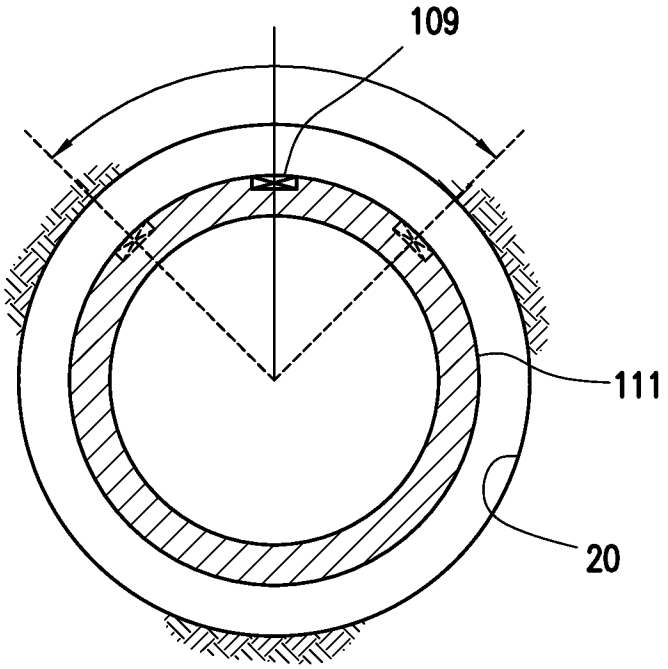

In some embodiments, strain gauge 109 may be used when drill string 101 is not rotating, for example during a sliding mode drilling operation or during trip in or out. In some embodiments, strain gauge 109 may be positioned at a location within wellbore 20 at which the curvature is desired to be calculated. Drill string 101 may be rotated at least a partial turn within wellbore 20. In a case where an entire rotation is completed, as depicted in FIGS. 7A, 7B, a complete sinusoidal waveform may be determined, from which the degree and direction of curvature at the location may be determined. In a case where a partial rotation is completed, as depicted in FIGS. 8A, 8B, the output of strain gauge 109 in at least 3 angular orientations may be logged, and the rest of the sinusoidal waveform may be calculated, from which the degree and direction of curvature at the location may be determined.

Figure 9:
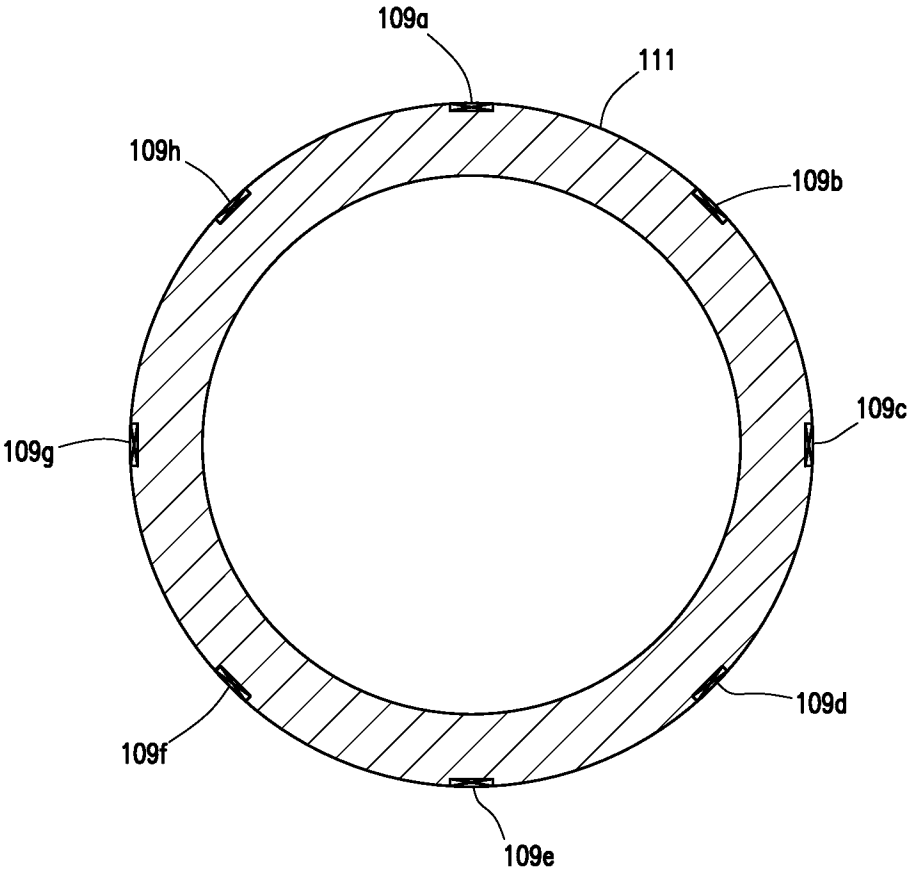
FIG. 9 depicts a cross section of a drill collar consistent with at least one embodiment of the present disclosure.
Figure 10B:
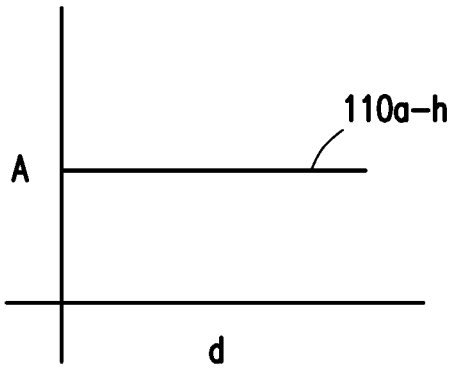
FIG. 10B depicts the output of the strain gauges of the drill collar in the wellbore of FIG. 10A while in the sliding mode.
Figure 10C:
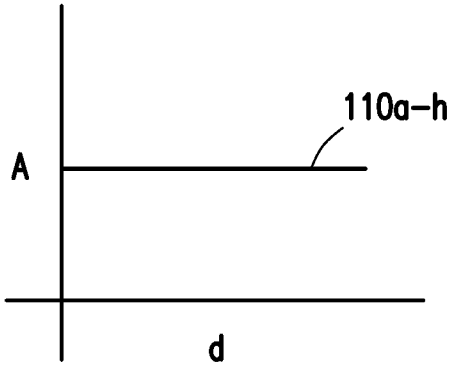
FIG. 10C depicts the output of the strain gauges of the drill collar in the wellbore of FIG. 10A while rotating.
Figure 10A:
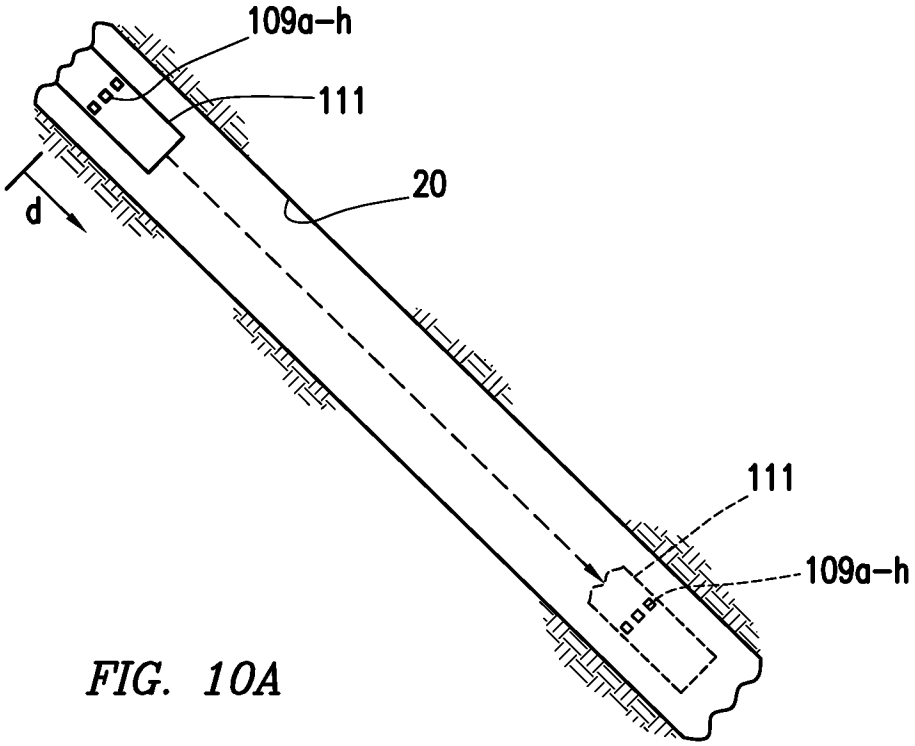
FIG. 10A depicts the drill collar of FIG. 9 positioned in a wellbore.

In some embodiments, as depicted in FIG. 9, multiple strain gauges (depicted in FIG. 9 as strain gauges 109*a-h*) may be positioned about drill collar 111. One having ordinary skill in the art with the benefit of this disclosure will understand that although depicted as including 8 strain gauges, drill collar 111 may include any number of strain gauges without deviating from the scope of this disclosure. As drill string 101 is moved through wellbore 20, each strain gauge 109*a-h* outputs a signal reflecting the compressive or tensile strain aligned therewith according to any bend of drill collar 111. When wellbore 20 is generally straight as depicted in FIG. 10A, drill collar 111 is not under bending stress. Thus, the amplitude of the output 110*a-h* from each strain gauge 109*a-h*, depicted in FIG. 10B in the sliding mode, is generally constant as drill collar 111 progresses through wellbore 20 due to the lack of bending moment imposed on drill collar 111. (Likewise, when rotating as depicted in FIG. 10C, the amplitude of the output 110*a-h* from each strain gauge 109*a-h* is generally constant)

Figure 11B:
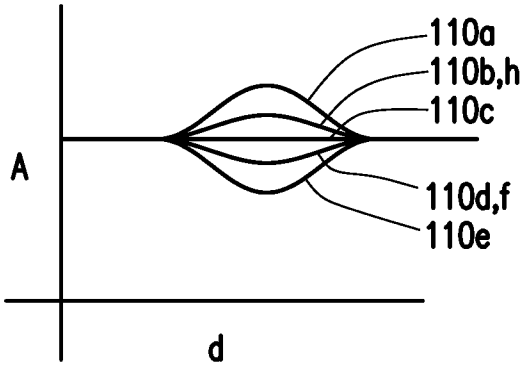
FIG. 11B depicts the output of the strain gauges of the drill collar in the wellbore of FIG. 11A while in the sliding mode.
Figure 11C:
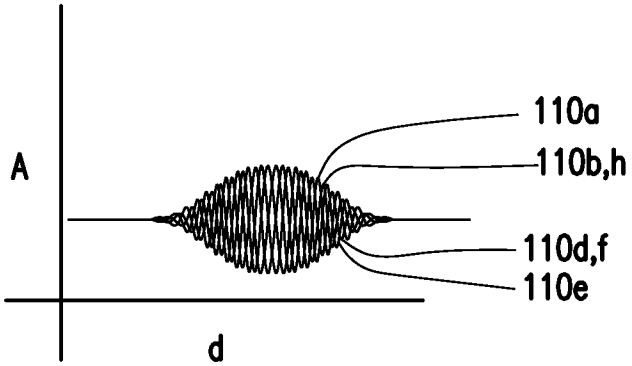
FIG. 11C depicts the output of the strain gauges of the drill collar in the wellbore of FIG. 11A while rotating.
Figure 11A:
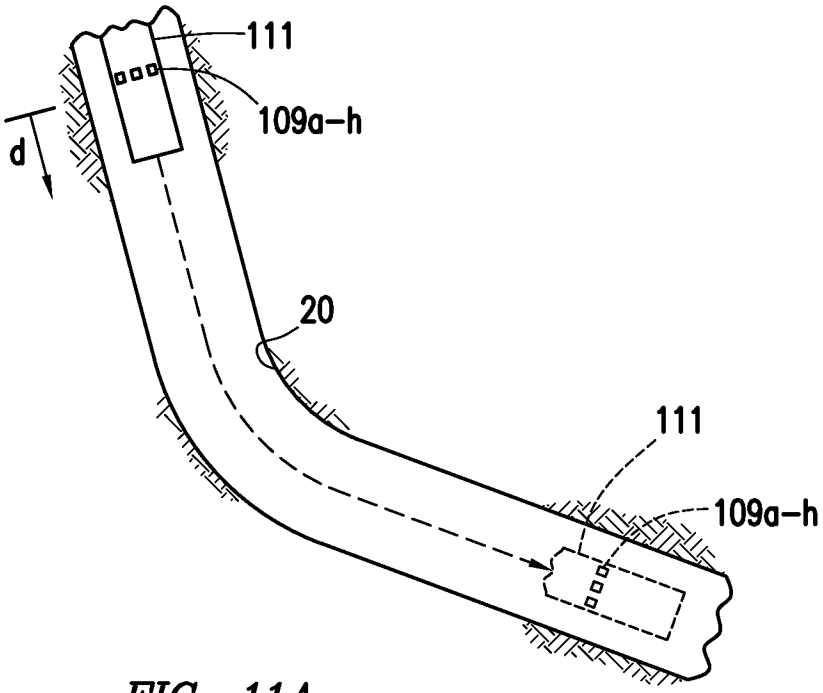
FIG. 11A depicts the drill collar of FIG. 9 positioned in a curved wellbore.

Alternatively, when wellbore 20 includes a curvature as depicted in FIG. 11A, drill collar 111 receives a bending moment from wellbore 20 as it passes therethrough. As understood in the art, the side of drill collar 111 on the inside of the curvature is placed under compressive stress, while the side of drill collar 111 on the outside of the curvature is placed under tensile stress. Thus, the amplitude of the output 110*a-h* from each strain gauge 109*a-h*, depicted in FIG. 11B, varies depending on the bending moment on drill collar 111 relative to the orientation of the strain gauge 109*a-h*. As understood in the art, the strain gauges nearest to the plane of bending of drill collar 111 may show the highest deflections (110*a*, 110*e* in FIG. 11B) while the strain gauges least aligned with the plane of bending of drill collar 111 may show the least deflections (110*c*, 110*g*). Sensor electronics 113 may utilize the output of strain gauges 109*a-h* to determine the direction and degree of curvature of wellbore 20 as drill collar 111 moves therethrough. In some embodiments, a maximum strain and the angle thereof may be interpolated from the outputs of the strain gauges 109*a-h* to account for a case where the bend is not aligned with one of the strain gauges 109*a-h*. (As discussed previously, when rotating, the amplitude of the output 110*a-h* of each strain gauge 109*a-h* generally conforms to a sine wave when traversing the curved portion of the borehole.

In some embodiments, by knowing the physical stresses and strains experienced by drill string 101, correction of mechanically induced bias in other sensor data may be detected and removed. Additionally, by knowing accurate positioning of the sensors determined by the model of wellbore 20 rather than a least curvature model when data is taken, models generated therefrom may be improved.

Figure 12A:
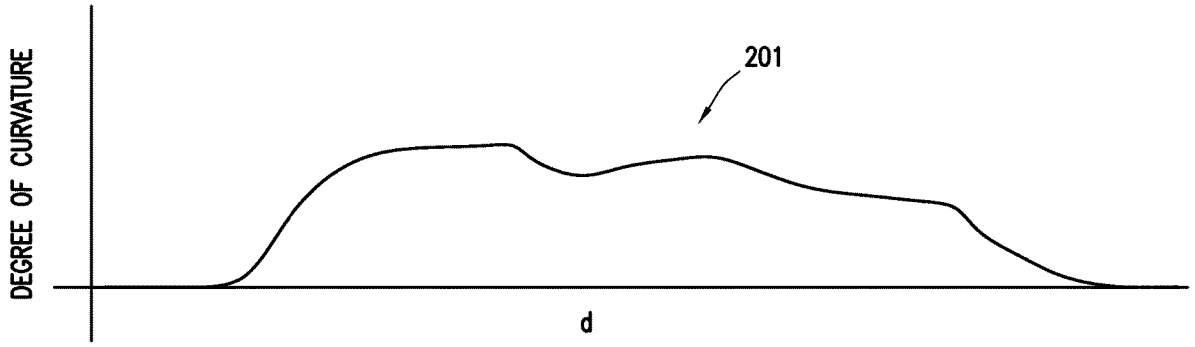
FIGS. 12A, 12B depict example parametric models of degree of curvature and angle of curvature respectively generated according to at least one embodiment of the present disclosure.
Figure 12B:
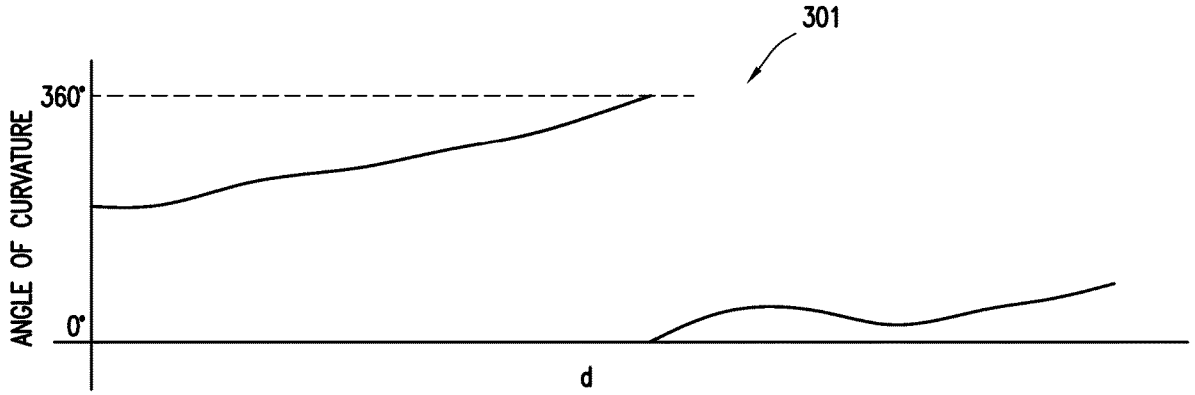

With reference to FIGS. 12A, 12B, the amplitude and orientation data may be combined with depth information to generate parametric models such as degree of curvature model 201 as depicted in FIG. 12A and a direction of curvature model 301 as depicted in FIG. 12B. The degree of curvature model 201 may show the amount or severity of the curvature at a given depth d along the wellbore. Likewise, the direction of curvature model 301 may show the direction of the curvature at a given depth d along the wellbore with respect to the reference frame as previously discussed. As understood in the art, degree of curvature model 201 and direction of curvature model 301 may be utilized to form a three dimensional model as depicted in FIG. 6.

In some embodiments, as depicted in FIG. 1, strain gauge 109 may be positioned as close to drill bit 105 as is practical. In some embodiments, the wellbore curvature data obtained may be used to offset a minimum curvature model as previously discussed.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method for determining curvature of a wellbore, the curvature having a magnitude and an orientation, the method comprising:

a) coupling a first strain gauge to a tubular member;

b) positioning the tubular member in the wellbore such that the tubular member is placed under bending stress by a curvature or deviation in the wellbore;

c) at least partially rotating the tubular member within the wellbore;

d) using only the first strain gauge to measure mechanical strain on the tubular member as a function of time as the tubular member rotates so as to generate a time-based single-strain-gauge output;

e) recording an amplitude of the output generated in step d); and f) determining one or more of the magnitude or orientation of the curvature of the wellbore based on the amplitude recorded in step e).

2. A method for determining curvature of a wellbore, the curvature having a magnitude and an orientation, the method comprising:

coupling a first strain gauge to a tubular member;

positioning the tubular member in the wellbore such that the tubular member is placed under bending stress by a curvature or deviation in the wellbore;

rotating the tubular member within the wellbore;

using only the first strain gauge to measure mechanical strain on the tubular member as a function of time as the tubular member rotates through a full rotation so as to generate a time-based single-strain-gauge output;

determining the difference between a maximum and a minimum amplitude of the output of the time-based single-strain-gauge output over the course of the full rotation so as to define an amplitude differential; and calculating a degree of curvature of the wellbore from the amplitude differential.

3. The method of claim 2, wherein the amplitude of the output of the first strain gauge is recorded in at least 3 angular orientations within a partial rotation of the tubular member; the method further comprises:

interpolating a sinusoidal waveform from the 3 amplitude recordings;

determining the difference between a maximum and a minimum amplitude of the sinusoidal waveform, defining an amplitude differential; and wherein the calculating operation utilizes the amplitude differential.

4. The method of claim 2, further comprising:

moving the tubular member through the wellbore while rotating continuously; and recording the position of the first strain gauge within the wellbore for each recording of the amplitude of the output of the first strain gauge.

5. The method of claim 4, further comprising:

determining the difference between a maximum and a minimum amplitude of the output of the strain gauge corresponding generally to a recorded position of the first strain gauge within the wellbore, the difference defining an amplitude differential;

wherein the calculating operation utilizes the amplitude differential to determine the degree of curvature at the position within the wellbore.

6. The method of claim 5, further comprising:

recording the angular offset of the first strain gauge relative to a reference frame for each recording of the amplitude of the output of the strain gauge;

determining the angular offset corresponding to the recording for the maximum or minimum amplitude of the output of the first strain gauge; and calculating the direction of the curvature of the wellbore at the location.

7. The method of claim 6, further comprising:

computing one or more of an azimuth of the path of the wellbore, an inclination of the path of the wellbore, or a model of the path of the wellbore between the first and the second locations.

8. The method of claim 1, further comprising:

recording the angular offset of the first strain gauge relative to a fixed reference frame for each recording of the amplitude of the output of the first strain gauge; and calculating a direction of curvature of the wellbore from the amplitude.

9. The method of claim 8, wherein the tubular member is rotated a full rotation, and wherein the step of calculating a direction of curvature of the wellbore from the amplitude comprises:

determining a maximum or minimum amplitude of the output of the first strain gauge over the course of the rotation; and determining the angular offset corresponding to the recording for the maximum or minimum amplitude of the output of the first strain gauge.

10. The method of claim 8, wherein the amplitude of the output of the first strain gauge is recorded at least 3 angular orientations within a partial rotation of the tubular member; the method further comprises:

interpolating a sinusoidal waveform from the 3 amplitude recordings;

interpolating an interpolated angular offset for each of the 3 amplitude recordings from the recorded angular offsets; and wherein the step of calculating a direction of curvature of the wellbore from the amplitude comprises:

determining a maximum or minimum amplitude of the sinusoidal waveform; and determining the angular offset corresponding to the recording for the maximum or minimum amplitude of the output of the first strain gauge.

11. The method of claim 8, further comprising:

moving the tubular member through the wellbore while rotating; and recording the position of the strain gauge within the wellbore for each recording of the amplitude of the output of the first strain gauge.

12. The method of claim 11, further comprising:

determining the difference between a maximum and a minimum amplitude of the output of the first strain gauge corresponding generally to a recorded position of the first strain gauge within the wellbore, the difference defining an amplitude differential;

determining the angular offset corresponding to the maximum or minimum amplitude of the output of the strain gauge corresponding to the position of the first strain gauge within the wellbore; and calculating the direction and degree of curvature at the position within the wellbore using the amplitude differential and the determined angular offset.

13. The method of claim 1, further comprising coupling a second strain gauge to the tubular member such that the second strain gauge is positioned opposite the first strain gauge.

14. The method of claim 2, further comprising:

moving the tubular member from a first location within the wellbore to a second location within the wellbore; and computing one or more of an azimuth of the wellbore, an inclination of the wellbore, or a model of the path of the wellbore between the first and the second locations.

15. The method of claim 14, wherein the tubular member is moved from the first location to the second location in a sliding mode.

16. The method of claim 1, further comprising:

moving the tubular member from a first location within the wellbore to a second location within the wellbore; and computing one or more of an azimuth of the wellbore, an inclination of the wellbore, or a model of the path of the wellbore between the first and the second locations.

* * * * *